US008602844B2

(12) United States Patent
Roth

(10) Patent No.: US 8,602,844 B2
(45) Date of Patent: Dec. 10, 2013

(54) METHOD AND APPARATUS FOR WORKING ON WORKPIECES WITH A WATER JET THAT CONTAINS ABRASIVE AND EMERGES UNDER HIGH PRESSURE FROM A NOZZLE

(75) Inventor: Philipp Roth, Baden (CH)

(73) Assignee: ALSTOM Technology Ltd, Baden (CH)

( * ) Notice: Subject to any disclaimer, the term of this patent is extended or adjusted under 35 U.S.C. 154(b) by 557 days.

(21) Appl. No.: 12/891,946

(22) Filed: Sep. 28, 2010

(65) Prior Publication Data

US 2011/0081834 A1 Apr. 7, 2011

(30) Foreign Application Priority Data

Oct. 1, 2009 (DE) ..... 10 2009 043 697

(51) Int. Cl.
*B24B 1/00* (2006.01)
*B24B 3/04* (2006.01)

(52) U.S. Cl.
USPC ..... 451/40; 451/39; 451/91; 451/99; 451/446

(58) Field of Classification Search
USPC ..... 417/300, 310, 395, 404; 451/38, 39, 40, 451/75, 90, 91, 99, 101, 446
See application file for complete search history.

(56) References Cited

U.S. PATENT DOCUMENTS

| | | | | |
|---|---|---|---|---|
| 2,984,188 | A * | 5/1961 | Tuckey et al. | 417/379 |
| 4,408,626 | A | 10/1983 | Fujiwara | |
| 4,669,230 | A * | 6/1987 | Suzuki et al. | 451/2 |
| 4,768,314 | A * | 9/1988 | Thomson | 451/99 |
| 4,818,191 | A * | 4/1989 | Schlake | 417/390 |
| 4,854,090 | A | 8/1989 | Heron et al. | |
| 4,872,293 | A | 10/1989 | Yasukawa et al. | |
| 5,160,548 | A | 11/1992 | Boisture | |
| 7,040,962 | B2 * | 5/2006 | Makino et al. | 451/39 |
| 7,749,049 | B2 * | 7/2010 | Hunter et al. | 451/7 |
| 8,257,147 | B2 * | 9/2012 | Summers et al. | 451/38 |
| 2006/0099888 | A1 * | 5/2006 | Ishibashi et al. | 451/38 |

FOREIGN PATENT DOCUMENTS

| | | |
|---|---|---|
| DE | 3121103 | 2/1982 |
| DE | 29612046 | 10/1996 |
| DE | 19909377 | 9/2000 |
| DE | 19910563 | 9/2000 |
| DE | 112007001276 | 4/2009 |
| DE | 112007002079 | 7/2009 |

(Continued)

OTHER PUBLICATIONS

Search Report from European Patent App. No. 10180557.0 (Mar. 15, 2011).

(Continued)

*Primary Examiner* — Timothy V Eley

(57) ABSTRACT

In a method for producing a water jet (45) that contains abrasive and emerges under high pressure from a nozzle (44), uninterrupted operation with, at the same time, greater working performance and lower costs is made possible in that, in a first step, an abrasive suspension (34) containing abrasive and water is provided at normal pressure, in a second step the provided abrasive suspension (34) is brought to a working pressure that is greatly above normal pressure, and in a third step a water jet (45) containing abrasive is produced, with a nozzle (44), from the abrasive suspension (34) that is under the working pressure.

21 Claims, 3 Drawing Sheets

(56) References Cited

FOREIGN PATENT DOCUMENTS

| | | |
|---|---|---|
| GB | 2073630 | 10/1981 |
| WO | WO97/31752 | 9/1997 |
| WO | WO2005/051598 | 6/2005 |
| WO | WO2008/001111 | 1/2008 |

OTHER PUBLICATIONS

Search Report for German Patent App. No. 10 2009 043 697.9 (Feb. 23, 2010).

* cited by examiner

METHOD AND APPARATUS FOR WORKING ON WORKPIECES WITH A WATER JET THAT CONTAINS ABRASIVE AND EMERGES UNDER HIGH PRESSURE FROM A NOZZLE

This application claims priority under 35 U.S.C. §119 to German application number No. 10 2009 043 697.9, filed 1 Oct. 2009, the entirety of which is incorporated by reference herein.

BACKGROUND

1. Field of Endeavor

The present invention relates to the field of working on workpieces with water jets. It concerns a method for working on, in particular cleaning, a workpiece with a water jet that contains abrasive and emerges from a nozzle under high pressure, and to a water jet installation useful for executing the method. Moreover, the invention relates to a method for application of the water jet method.

2. Brief Description of the Related Art

Components of power plant installations are subject to high mechanical and thermal load during their operation. This applies particularly to gas turbine components exposed to the flow of hot gas, whose surfaces, in addition to being exposed to the extreme mechanical and thermal loads, are additionally exposed to unwanted thermal and chemical reactions with the formation of non-metallic layers, such as scale or corrosion coverings, with negative effects on the operating behavior. This necessitates regular service intervals for checking the state of these components and removing and/or cleaning, repairing or, if necessary, replacing them.

Methods for cleaning gas turbine components such as, for example, blades, are known in a multiplicity of realizations. The methods that are known and have been introduced in this field include that of sand blasting. Air that is compressed to a plurality of bars and to which an abrasive material is added, is directed on to the surface to be treated. The particles of the abrasive material impacting with high energy on the surface produce a cleaning effect. Disadvantages of this method, however, are an imprecise scattering and a relatively coarse removal of material, with disadvantageous alterations of the surface quality of the workpiece.

Another type of cleaning method is based on the high-pressure water jet technique, wherein pure water jets or water jets mixed with an abrasive are applied to the surface to be cleaned. The high-pressure water jet technique uses water pressures of up to 600 MPa, in order to produce a high-power water jet. Such a high-power water jet can be used as a tool for cutting or cleaning applications that acts in all directions.

Depending on the respective application, water jets operating according to three differing principles are used, namely:

(1) pure water jets (see FIG. 1), (2) water jets containing abrasive that are generated through injection of an abrasive into a previously produced pure water jet (abrasive injection water jets, AIWJ; see FIG. 2), and (3) water jets containing abrasive in which the jet is produced through a pressurized suspension of the abrasive emerging from a nozzle (abrasive suspension water jets, ASWJ; see FIG. 3).

In the case of the first principle, represented in simplified form in FIG. 1, in a water jet installation 10 water is fed to a pressure pump 12 via a water feed line 11 and pumped at high pressure into a pressure line 13, which leads to a suitable nozzle 14. The water under high pressure in the pressure line 13 then emerges from the nozzle 14 as required, forming a high-energy water jet. Such pure water jets can be used to cut soft materials such as, for example, fabrics, leather, solidified foams, foodstuffs, etc.

For cleaning applications, it is mainly systems operating with a pure water jet that are used. Typical parameters for cleaning with a pure water jet are working pressures of up to 300 MPa and volumetric flow rates of approximately 30 liters/min, which result in a high energy consumption (up to 150 kW). Corresponding high-pressure pumps are likewise very expensive.

In the case of the second principle, represented in FIG. 2, in a water jet installation 20 water is again fed to a pressure pump 12 via a water feed line 11 and pumped at high pressure into a pressure line 13, which leads to a suitable nozzle 14. The water under high pressure in the pressure line 13 then emerges from the nozzle 14 as required, forming a high-energy water jet. In a succeeding mixing tube 16, an abrasive is then admixed to the pure water jet, in an injection device 17, which abrasive has been brought via an abrasive feed 18. A high-energy water jet 19 containing abrasive then emerges at the end of the mixing tube 16. Such an installation is described, for example, in the printed publication WO-A1-2005/051598. Such AIWJ jets (abrasive injection water jets) are used mainly in stationary cutting applications. They can be used to cut all technical materials, such as:

all metals (steel, aluminum, copper, titanium, etc)
glass
synthetic materials
composite materials, and
concrete.

The ASWJ jets (abrasive suspension water jets) produced according to the third principle are generally used for mobile and special applications. The advantages of the ASWJ jets, as compared with the AIWJ jets produced according to the second principle, are a higher efficiency (higher by a factor of up to 4-5) and the possibility of being able to use these jets in all positions and environments.

In the case of the third principle, represented in FIG. 3, in a water jet installation 30 water is again fed to a pressure pump 12 via a water feed line 11 and pumped at high pressure (up to 200 MPa) into a pressure line 13, which leads to a suitable nozzle 14. At a T-piece 21, the flow of water is divided. One portion flows directly to the nozzle 14, via a first choke valve 27 and a mixing piece 28. A second, smaller portion flows in a bypass line 23, via a second choke valve 22, into a pressure tank 24 that is filled with abrasive and that is refillable after removal of a blind plug 25, and from there flows, via a shutoff valve 26, to the mixing piece 28. As the water flows through the pressure tank 24, it carries the abrasive particles along with it. Then, in the mixing piece 28, the resultant water/abrasive mixture is put into the main water flow. The proportion of abrasive in the water jet 29 that contains abrasive and emerges from the nozzle 14 can be controlled by the choke valves 22 and 27. Such a system is described, for example, in the printed publication DE-A1-199 09 377.

The main disadvantages of the currently known systems operating, according to the third principle, with pressures of between 50 MPa and 200 MPa are:

the imprecise control of the proportion of abrasive in the suspension;

the lack of possibility of continuous operation, since after a certain period of time it is necessary to interrupt operation and refill the pressure tank with abrasive; and the high working pressures require correspondingly dimensioned components of the water jet installation, with the consequence of more difficult handling and a limited scope of application in respect of confined spatial conditions.

SUMMARY

One of numerous aspects of the present invention includes a method, in particular suitable for cleaning applications, for treating workpieces with a water jet that contains abrasive and emerges under high pressure from a nozzle, which method can be operated continuously and avoids the disadvantages of known methods described above, and a water jet installation for executing the method. Another aspect includes providing such a method and such an installation that meet the requirements of use for power plant installations, for example turbines. This domain of application requires effective use in confined spatial conditions, such as in narrow gaps, and moreover is highly demanding with respect to the surface quality following the working operation.

Another aspect of the present invention includes, in a first step, an abrasive suspension containing abrasive and water is provided at normal pressure, in a second step the provided abrasive suspension is brought to a working pressure that is above normal pressure, and in a third step a water jet containing abrasive is produced, with a nozzle, from the abrasive suspension that is at the working pressure.

Owing to the preparation of the suspension being effected at normal pressure, suspension can be provided continuously, without the need to interrupt the production and application of the jet. In a manner known per se, in this case the abrasive contained in the water very greatly augments the cleaning effect of the jet.

According to one exemplary embodiment of the invention, a mixture of water and the abrasive is produced in an open mixing vessel, for the purpose of providing the abrasive suspension that is at normal pressure. It is thereby ensured that the suspension in the mixing vessel can be replenished without difficulty at any time.

Preferably, the mixture in the mixing vessel is kept continuously in motion, in particular by an agitator.

Another exemplary embodiment of the method is distinguished in that a working pressure of a plurality of MPa, in particular of approximately 15 MPa to 25 MPa, is used. The comparatively low working pressure makes it possible to use less expensive components (e.g., pumps) and reduces the energy consumption. In addition, another advantage of the invention includes that the low working pressure allows the use of small-dimension and flexible components of the water jet installation, such as pressure lines and cleaning heads, as a result of which even those surfaces that are difficult to access can be treated effectively. As a result, in certain cases, it is possible to dispense with the resource-intensive removal of the workpieces to be cleaned. In the power plant industry, above all, this constitutes an advantage not to be underestimated, resulting in considerable cost savings for the power plant operator.

According to a further preferred embodiment, an abrasive having a hardness of at least 7 according to the Mohs scale is added to the water. The particles of the abrasive have a diameter in the range from 0.1 mm to 0.3 mm.

Preferably, the abrasive suspension is brought to the working pressure by a pump, and the abrasive suspension brought to working pressure is routed from the output of the pump directly to the nozzle, via a pressure line, a diaphragm pump, in particular, being used as a pump.

An embodiment of the water jet installation according to principles of the present invention is characterized in that the pump is a diaphragm pump, the diaphragm pump has a pump chamber that is delimited by a diaphragm and connected to the intake line via an inlet valve and connected to the pressure line via an outlet valve, and the valves each have a valve sleeve, which constitutes a central valve passage and which is closed, at the downstream end, by a closing element that rests on a valve seat and that is spring-biased contrary to the direction of flow. In comparison with other pump types, such as piston pumps, the use of a diaphragm pump has the advantage of low wear.

A preferred further development is characterized in that the valve sleeve and the closing element of the valves are produced from a hard metal, in particular tungsten carbide, and the valve seats are ground-in.

In particular, the closing element is ball-shaped in the region corresponding to the valve seat, and is biased in the closing direction by a pressure spring.

Another embodiment of the installation according to principles of the present invention is characterized in that a pressure relief valve is arranged in the pressure line.

Preferably, the mixing vessel has an agitator equipped with a motor, and is realized as an open vessel.

Methods embodying principles of the present invention can be used, advantageously, for cutting and/or cleaning tasks in the case of power plant components, in particular boilers, heat exchangers and turbines.

Through application of features defined more fully herein, it has become possible, for the first time, to combine in an advantageous manner the advantages of various known methods of the water jet technique and thereby to open up new application possibilities for this technique.

BRIEF DESCRIPTION OF THE DRAWINGS

The invention is to be explained more fully in the following with reference to exemplary embodiments in conjunction with the drawing, wherein.

DETAILED DESCRIPTION OF EXEMPLARY EMBODIMENTS

Figure 4:
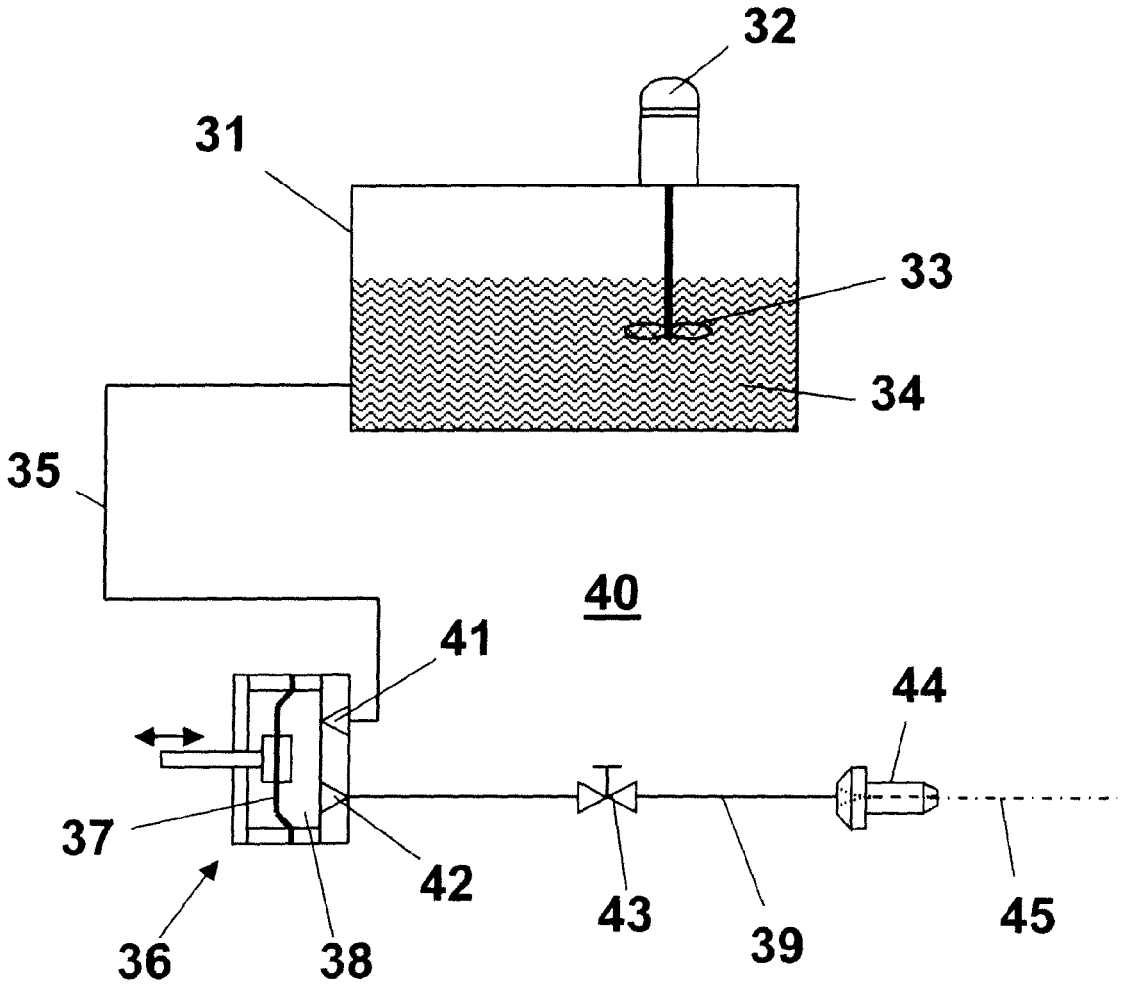
FIG. 4 shows the simplified diagram of a water jet installation, according to an exemplary embodiment of the invention, operating with abrasive suspension.

The simplified diagram of a water jet installation operating with abrasive suspension, according to an exemplary embodiment of the invention, is reproduced in FIG. 4. The water jet installation 40 includes a mixing vessel 31, a diaphragm pump 36 that on its input side is connected, via an intake line 35, to the mixing vessel 31, and a nozzle 44 connected to the output of the diaphragm pump 36 via a pressure line 39.

An abrasive suspension 34 is mixed and held ready under normal pressure in the mixing vessel 31. An agitator 33, which is driven by a motor 32, is provided to mix and maintain the abrasive suspension. The mixing vessel 31 can be open at the top, such that the components of the abrasive suspension can be replenished if required and without interruption of operation. The operation under normal pressure facilitates considerably the controlled addition of water and abrasive to the mixing vessel 31 for the purpose of maintaining a constant mix ratio. Variants of an automated loading of the mixing vessel 31 are preferred in this case, and can be realized with comparatively simple technical systems. Continuous operation of the water jet installation is therefore ensured with a small amount of equipment.

The diaphragm pump 36, which has a pump chamber 38 delimited by a diaphragm 37, draws in suspension from the mixing vessel 31, via an inlet valve 41, during an intake stroke (movement to the left in FIG. 4) and, in a working stroke (movement to the right in FIG. 4), forces it at high pressure into the pressure line 39, via an outlet valve 42. The suspension flows via the pressure line 39 (in which a pressure relief valve is arranged, in order to prevent damage to the pump 36 as a result of excess pressure) directly to the nozzle 44, which is composed of hard metal (tungsten carbide). There, a water jet 45 is realized, which contains abrasive and which, depending on the requirement of the application, can be of a concentrated, spread or other form.

Figure 1:
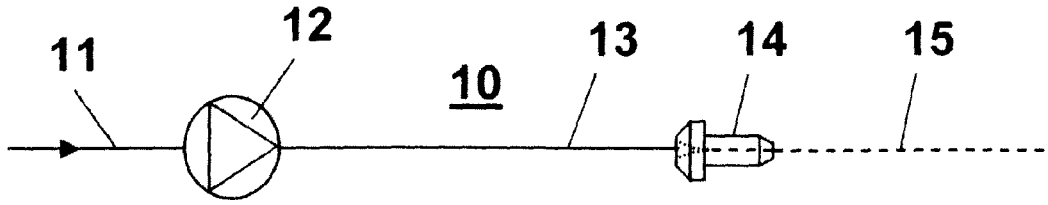
Fig.1 (prior art)
FIG. 1 shows the simplified diagram of a water jet installation, according to the prior art, operating with pure water.
Figure 2:
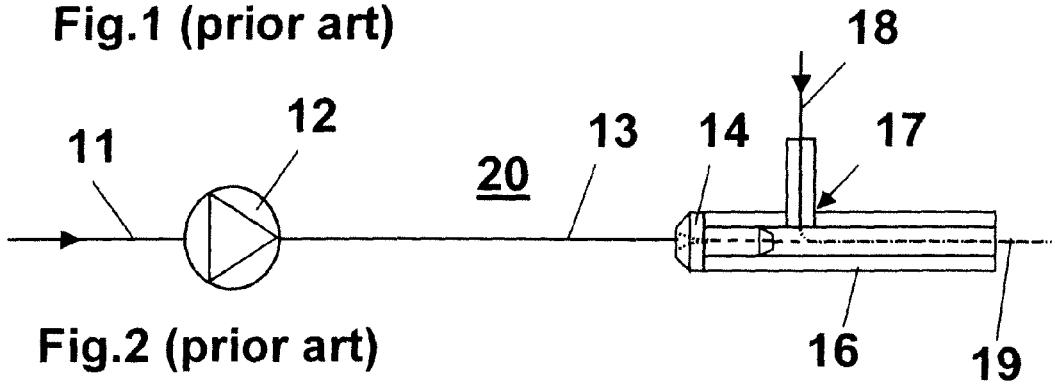
Fig.2 (prior art)
FIG. 2 shows the simplified diagram of a water jet installation, according to the prior art, operating with added abrasive, according to the injection principle.
Figure 3:
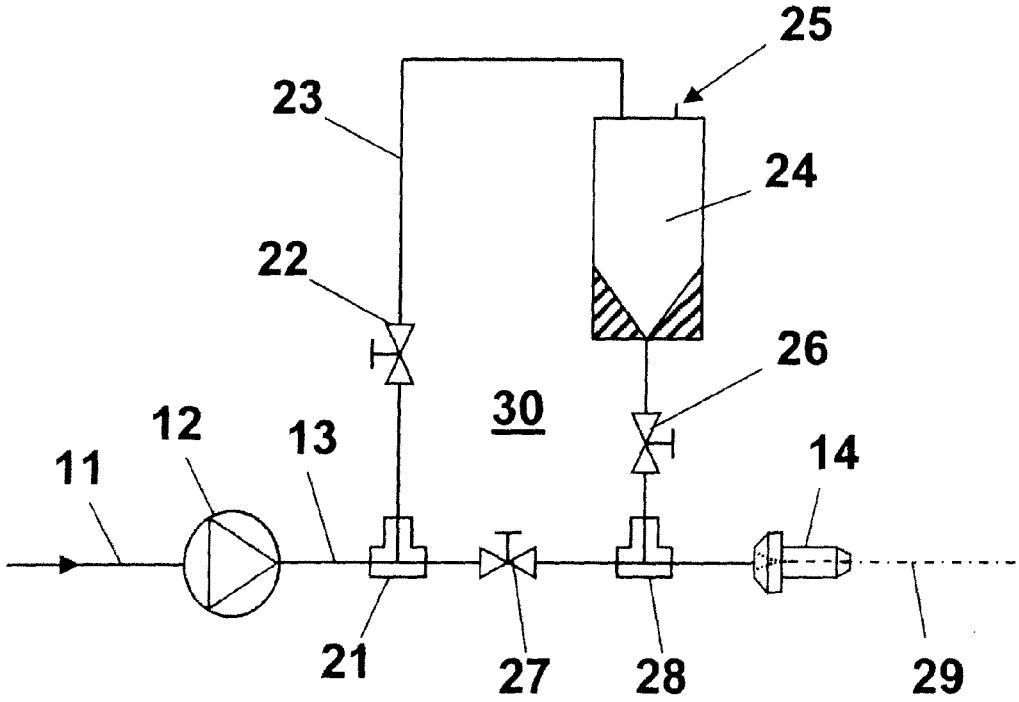
Fig.3 (prior art)
FIG. 3 shows the simplified diagram of a water jet installation, according to the prior art, operating with abrasive suspension.

Owing to the abrasive component in the water jet, the pressure in the pressure line 39 can be reduced, as compared with the technique operating with pure water (FIG. 1), from 200 MPa to 15 MPa to 25 MPa, preferably 20 MPa, without impairing the cleaning effect. This allows the use of small-dimension pressure lines in the form of flexible tubes having diameters of less than 12 mm. Such flexible tubes have a high flexibility (radius of bend less than 50 mm) and are therefore also suitable for use in confined spatial conditions such as, for example, those prevailing within the blading of turbines.

Owing to the abrasive component in the pumped suspension, a diaphragm pump 36, the structure and function of which are described, for example, in the printed publication U.S. Pat. No. 6,899,530, can be used instead of a conventional piston pump. These pumps are normally used for pumping corrosive and abrasive media, but at comparatively low pressures. In the present application, the drawn-in suspension is brought to pressures of approximately 15 MPa to 25 MPa by such a pump. Operation at these pressures is achieved in that the inlet and outlet valves 41, 42, which are subject to particular wear, have been modified according to FIGS. 5 and 6.

Diaphragm pumps are pumps that operate volumetrically, which produce pressure through the mechanical displacement of synthetic diaphragms. In order to achieve a constant pressure and flow, each pump chamber (38 in FIG. 4) is equipped with two valves (41, 42 in FIG. 4). A pump contains mostly three to five such pump chambers. Owing to the high flow velocity of the abrasive suspension upon opening of the valves, it is mainly the latter that are subject to wear (the erosion is very largely dependent on the velocity of the eroding particles).

Figure 5:
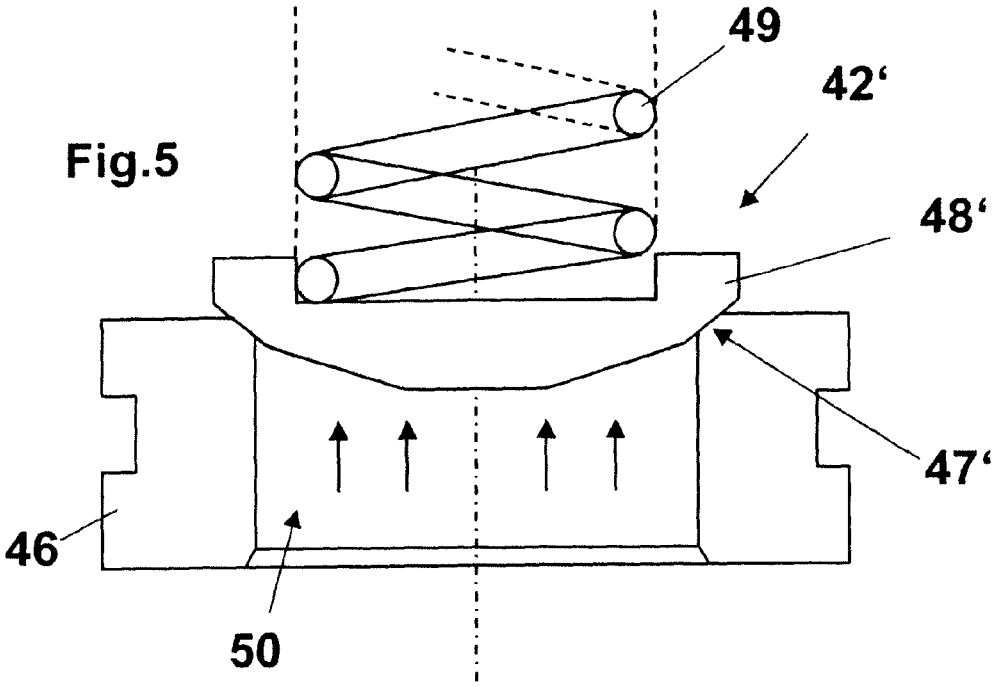
FIG. 5 shows the longitudinal section through a conventional inlet or outlet valve of a diaphragm pump suitable for the installation according to FIG. 4.

The standard design of the valves of the pump chamber of a diaphragm pump of the type described is reproduced in FIG. 5: the valve 42' of FIG. 5 includes an (annular) valve sleeve 46, which delimits a central valve passage 50. At the downstream end of the valve sleeve 46, a disc-shaped closing element 48' is pressed against a valve seat 47' by a pressure spring 49, and thus closes off the valve passage 50 and therefore the adjoining pump chamber. If pressure is generated in the pump chamber 38 by the diaphragm 37, the closing element 48' lifts away from the valve seat 47', against the pressure of the spring 49, and a volumetric flow leaves the pump chamber 38 through the associated valve passage.

In the case of the valve 42', a main problem consists in that, if the valve does not close properly, or no longer closes properly, high local flow velocities occur at the site of the leakage, and erode the closing element 48' and the valve sleeve 46 to a very great extent. Even tungsten carbide valves become thus eroded in less than half an hour. The reason for the lack of tightness in the case of such standard valves is the lack of centering of the disk-shaped closing element 48' in the valve sleeve 46: the closing element 48' does not have sufficient guidance and, owing to the (flat) shape of the standard closing element 48' (ground-in radius of the valve seat 47'), there are some regions in which there is no surface contact between the closing element 48' and the valve seat 47' if the closing element 48' is not perfectly centered.

Figure 6:
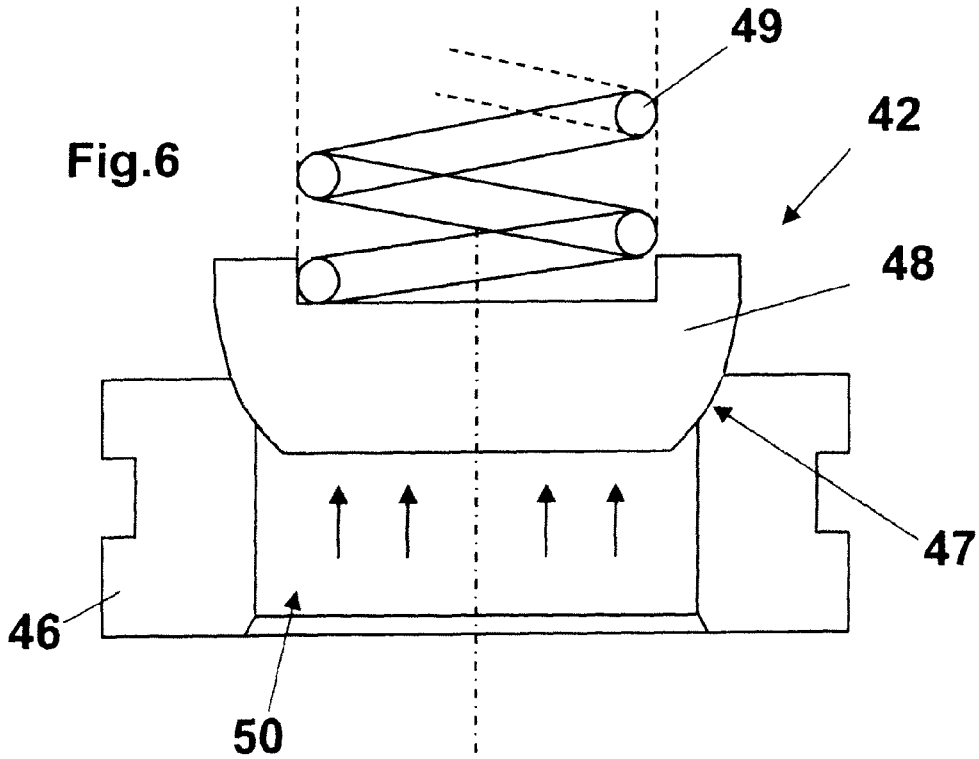
FIG. 6 shows the longitudinal section through an inlet or outlet valve modified with respect to FIG. 5 and optimized for the installation according to FIG. 4.

In order to remedy this, the valve geometry has been altered, according to FIG. 6. The closing element 48 of the valve 42 now has the shape of a ball, or portion of a ball. The result of this is that, even if the closing element 48 is not perfectly centered, there is nevertheless surface contact on the entire circumference of the valve seat 47, and tightness is achieved. At the same time, the contact surface on the valve seat 47 has been enlarged considerably. Moreover, all sealing surfaces have been ground-in, in order to achieve a good seal. Tungsten carbide is used as a material for the closing element 48 and the valve sleeve 46. It has been found that, because of these measures, the required service intervals can be extended considerably. Intervals of 50 operating hours and more have been found to be sufficient.

With an installation according to FIG. 4, a water jet containing abrasive can now be produced with a pressure of approximately 15 MPa up to 25 MPa in continuous operation, which water jet can be used, particularly advantageously, in the domain of power plant engineering. In particular, the following cleaning tasks can be performed:

In the case of steam boilers, the tubes of the tube bundle can be cleaned.

In the case of turbines, the blading or other components can be cleaned, it being possible, frequently, to dispense with removal of the same since, according to principles of the present invention, even spaces between the blades can be cleaned in an effective manner when in the mounted state. This allows considerable cost savings as compared with conventional methods of cleaning.

Furthermore, advantageously, according to principles of the present invention, surfaces in power plants can be worked on:

Water jet honing: the central bores of steam turbine rotors are worked on. This enables the machine times to be reduced considerably, as compared with conventional methods.

Blade reconditioning: the blade surfaces of gas turbines are worked on, in order to remove surface cracks.

As compared with the systems based on pure water jets, the following advantages can be achieved in this case:

Lesser energy consumption;

Improved cleaning performance;

Settable surface characteristics in the case of the surfaces to be worked on;

Superior surface quality;

Settable material removal rates;

Improved handling capability, owing to the reduced pressure;

Smaller dimensions of feed lines (for example, having a flexible tube diameter of less than 12 mm) and nozzles;

Smaller radius of bend of the feed line, of less than 50 mm, allows use in confined spatial conditions, even in narrow gaps; and Lower costs of the installation.

LIST OF REFERENCES

10,20,30,40 water jet installation
11 water feed line
12 pressure pump
13,39 pressure line
14,44 nozzle
15 water jet
16 mixing tube
17 injection device
18 abrasive feed
19,29,45 water jet (containing abrasive)
21 T-piece
22,27 choke valve
23 bypass line
24 pressure tank (with abrasive)
25 blind plug
26 shutoff valve
28 mixing piece
31 mixing vessel
32 motor
33 agitator
34 abrasive suspension
35 intake line
36 diaphragm pump
37 diaphragm
38 pump chamber
41 inlet valve
42,42' outlet valve
43 pressure relief valve
46 valve sleeve
47,47' valve seat
48,48' closing element
49 pressure spring
50 valve passage While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

I claim:

1. A method for working on a workpiece with a water jet that contains abrasive and emerges under high pressure from a nozzle, the method comprising:

first providing an abrasive suspension containing abrasive and water at a first pressure;

second bringing the abrasive suspension to a working pressure above said first pressure;

third directly feeding the abrasive suspension under the working pressure to a nozzle; and fourth issuing the abrasive suspension from the nozzle for acting on a workpiece surface.

2. The method as claimed in claim 1, wherein providing an abrasive suspension comprises producing a mixture of water and abrasive in an open mixing vessel at said first pressure.

3. The method as claimed in claim 2, wherein producing a mixture of water and abrasive comprises keeping the mixture in the mixing vessel continuously in motion.

4. The method as claimed in claim 3, wherein keeping the mixture in motion comprises keeping the mixture in motion with an agitator.

5. The method as claimed in claim 1, wherein bringing the abrasive suspension to a working pressure comprises bringing the abrasive suspension to a pressure of a plurality of MPa.

6. The method as claimed in claim 5, wherein the working pressure is between 15 MPa and 25 MPa.

7. The method as claimed in claim 1, wherein the abrasive has a hardness of at least 7 on the Mohs scale.

8. The method as claimed in claim 1, wherein the abrasive comprises particles having a diameter in the range from 0.1 mm to 0.3 mm.

9. The method as claimed in claim 1, wherein bringing the abrasive suspension to a working pressure comprises bringing the abrasive suspension to the working pressure with a pump, and further comprising:

routing the abrasive suspension at the working pressure from an output of the pump directly to the nozzle via a pressure line.

10. The method as claimed in claim 9, wherein the pump comprises a diaphragm pump.

11. A water jet installation useful for executing a method as claimed in claim 1, the water jet installation comprising:

a nozzle configured and arranged to produce a water jet;

a pressure line connected to the nozzle;

a pressure pump having an input side and an output connected to the pressure line to directly feed the abrasive suspension to the nozzle via the pressure line;

an intake line connected to the pump input side; and a mixing vessel connected to the intake line, the mixing vessel containing the abrasive suspension.

12. The water jet installation as claimed in claim 11, wherein the pump is a diaphragm pump.

13. The water jet installation as claimed in claim 11, wherein:

the diaphragm pump has a diaphragm delimiting a pump chamber, an inlet valve connected between the intake line and the pump chamber, and an outlet valve connected to the pressure line; and the inlet and outlet valves each comprise a valve sleeve having a central valve passage, a closing element, a valve seat on which the closing element rests, and a spring that biases the closing element opposite to the direction of flow, the closing element closing a downstream end of the valve passage.

14. The water jet installation as claimed in claim 13, wherein:

the valve sleeve and the valve closing element are formed of a hard metal; and the valve seats are ground-in.

15. The water jet installation as claimed in claim 14, wherein the hard metal is tungsten carbide.

16. The water jet installation as claimed in claim 13, wherein the closing element is ball-shaped in a region corresponding to the valve seat.

17. The water jet installation as claimed in claim 11, further comprising:

a pressure relief valve in the pressure line.

18. The water jet installation as claimed in claim 11, wherein:

the mixing vessel comprises an agitator with a motor; and the mixing vessel comprises an open vessel.

19. The method as claimed in claim 1, wherein said workpieces comprise power plant components.

20. The method as claimed in claim 19, wherein said power plant components comprise boilers, heat exchangers, or turbines.

21. The method as claimed in claim 1, wherein said first pressure is atmospheric pressure.

* * * * *